US008376421B2

(12) United States Patent
Simmonds

(10) Patent No.: US 8,376,421 B2
(45) Date of Patent: Feb. 19, 2013

(54) MAGNETIC GATE LATCH DEVICE

(75) Inventor: Carl Simmonds, Land O'Lakes, FL (US)

(73) Assignee: Nationwide Industries, Inc., Tampa, FL (US)

( * ) Notice: Subject to any disclaimer, the term of this patent is extended or adjusted under 35 U.S.C. 154(b) by 180 days.

(21) Appl. No.: 12/658,534

(22) Filed: Feb. 8, 2010

(65) Prior Publication Data

US 2011/0193354 A1 Aug. 11, 2011

(51) Int. Cl.
*E05C 19/16* (2006.01)
*E05C 17/56* (2006.01)

(52) U.S. Cl. ..... 292/251.5; 292/DIG. 29

(58) Field of Classification Search ..... 292/251.5, 292/276, 137, 177, 179, DIG. 29, 174, 145–146
See application file for complete search history.

(56) References Cited

U.S. PATENT DOCUMENTS 5,114,195 A * 5/1992 Martin et al. ..... 292/251.5
5,362,116 A * 11/1994 Doyle et al. ..... 292/144
5,469,805 A * 11/1995 Gibbs ..... 116/284
5,490,498 A * 2/1996 Faithfull et al. ..... 128/203.12
5,664,769 A * 9/1997 Sadinsky et al. ..... 256/73
5,823,026 A * 10/1998 Finke ..... 70/276
6,155,616 A * 12/2000 Akright ..... 292/207
6,666,435 B2 * 12/2003 Blosfelds ..... 256/73
7,044,511 B2 * 5/2006 Kliefoth et al. ..... 292/251.5
7,100,405 B2 * 9/2006 West ..... 70/100
7,390,035 B2 * 6/2008 Karcz et al. ..... 292/163
7,954,445 B2 * 6/2011 Satoh ..... 116/272
7,963,575 B2 * 6/2011 Mayo et al. ..... 292/169

* cited by examiner

*Primary Examiner* — Thomas A Beach
*Assistant Examiner* — Mark Williams
(74) *Attorney, Agent, or Firm* — Arthur W. Fisher, III

(57) ABSTRACT

A magnetic gate latch device to secure a gate in a locked position to a fence or other barrier to close or block a portal formed therein comprising a latch assembly including a lower latch pin coupled to an upper latch pin actuator by an intermediate interconnecting element mounted to the fence or other barrier adjacent the portal wherein the lower latch pin is normally biased in upper or unlocked position and a keeper assembly including a keeper base affixed to the gate and a keeper arm extending outwardly therefrom having a latch pin recess formed therein with a latch pin positioner comprising a vertically disposed magnet disposed adjacent the latch pin recess such that when the gate is closed the vertically disposed magnet of the latch pin positioner moves the lower latch pin, intermediate interconnecting element and upper latch pin from the normally biased upper or unlocked position to a lower or locked position drawing the latch pin into the latch pin recess against the force of the bias and when as the upper latch pin actuator is moved upwardly the intermediate interconnecting element and the lower latch pin are moved upwardly withdrawing the lower latch pin from the latch pin recess to permit the gate to be opened as the bias maintains the lower latch pin in upper or unlocked position.

18 Claims, 6 Drawing Sheets

MAGNETIC GATE LATCH DEVICE

BACKGROUND OF THE INVENTION

1. Field of the Invention

A magnetic latch device to secure a gate in a closed position to block an opening in a fence or other barrier.

2. Description of the Prior Art

Numerous devices and systems have been developed to prevent young children from entering a pool area without supervision including safety pool fences. Such safety pool fences usually include a self-latching device designed to operate automatically on closing the gate of the fence. These self-latching devices are designed to prevent the gate from being reopened without manual releasing of the mechanism.

U.S. Pat. No. 5,362,116 shows a self latching device to latch in two members which are otherwise movable relative to each other for use with a gate. The device comprises a latch arm mounted to one of the members movable between a latched position and a retracted position, and a retaining element with a permanent magnet mounted to the other member. The latch arm is normally spring biased in the retracted position but is moved by the magnetic field generated by the magnet to the latched position to secure the gate in a closed position.

U.S. Pat. No. 5,664,769 teaches a gate assembly for tensioned fences such as used to enclose the perimeter of home swimming pools. The gate in a preferred form is "U" shaped with no rigid bar at the top has the space between the bars of the gate filled with tensioned mesh fabric similar to the tensioned fence. The gate is supported by poles on each edge which provides spring closed hinging on one edge and an automatic latch at the opposite edge. The poles are pairs of poles at each side which together react to the tension of the fence without transferring the fence tension to the gate.

U.S. Pat. No. 7,044,511 relates to a magnetic latch system including a latch assembly and a keeper assembly. The keeper assembly includes a magnetically attractable keeper pin. The latch assembly includes a magnet and a movable internal lever to engage the keeper pin to move it away from the permanent magnet. The system may also include a lock to hold the internal lever in a fixed position so that it cannot be moved to move the keeper pin away from the magnet.

U.S. Pat. No. 7,100,405 shows a latching device for swimming pool gates including an automatic magnetic latch with a child resistant device to control access to the pool area. The child resistant device may include an operating handle at an elevated location to be out of the reach of the child and an alternative operating device is provided at a lower location with child resistance provided typically by a push button arrangement acting through a cam and cam follower to raise a latching arm against the biasing to the latching position.

Additional examples of the prior art are found in U.S. Pat. No. 5,114,195; U.S. Pat. No. 5,490,698; U.S. Pat. No. 5,823,026; U.S. Pat. No. 6,155,616; U.S. Pat. No. 6,666,435 and U.S. Pat. No. 7,390,035.

SUMMARY OF THE INVENTION

The present invention relates to a magnetic gate latch device comprising a latch assembly generally mounted to a fence post adjacent an opening or portal in a fence or other barrier and a keeper assembly attached to a gate movable between an open position and a closed position to close or block the opening or portal when the gate is in the closed position.

The latch assembly comprises an upper latch actuator coupled to a lower latch assembly by an intermediate interconnecting assembly.

The upper latch actuator comprises an actuator pull knob member and a recess or channel formed therein attached to the intermediate interconnecting assembly. A latch position indicator provides a visual indication of the position of the lower latch assembly relative to the keeper assembly to indicate when the latch assembly is in the upper or unlocked position and the lower or locked position.

The lower latch assembly comprises a lower latch pin or member attached to the lower portion of the intermediate interconnecting assembly and a bias disposed in surrounding relationship relative to the lower latch pin or member to normally bias the lower latch pin or member in the upper or unlocked position.

The keeper assembly comprises a latch base attached to the gate having a latch arm extending outwardly therefrom.

The latch arm comprises a latch pin receptacle including a latch pin recess formed therein to receive the lower latch pin or member when in the lower or locked position and a magnet recess to retain a vertically disposed magnet adjacent to the latch pin recess.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
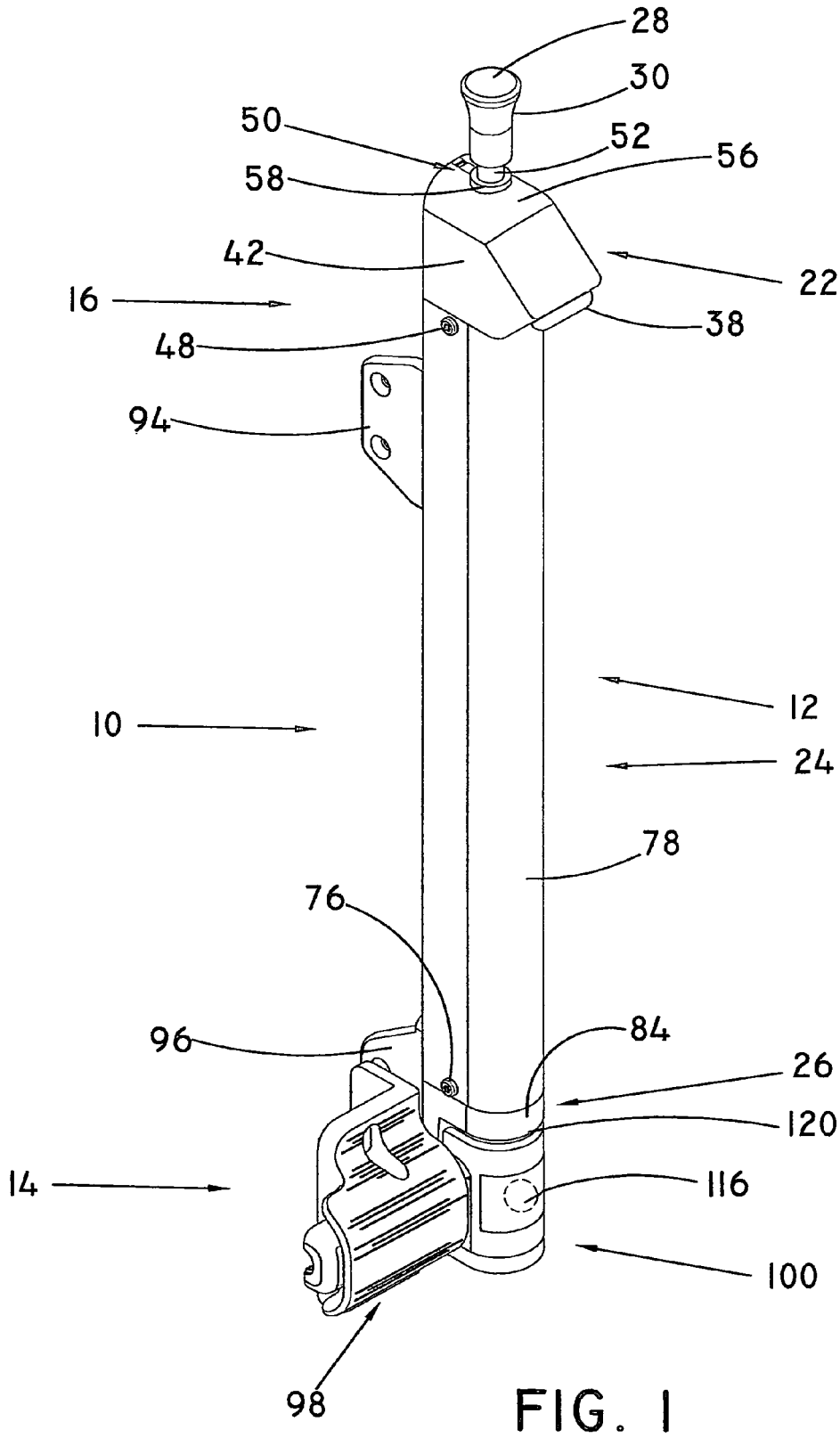
FIG. 1 is a perspective view of the magnetic latch device of the present invention.
Figure 2:
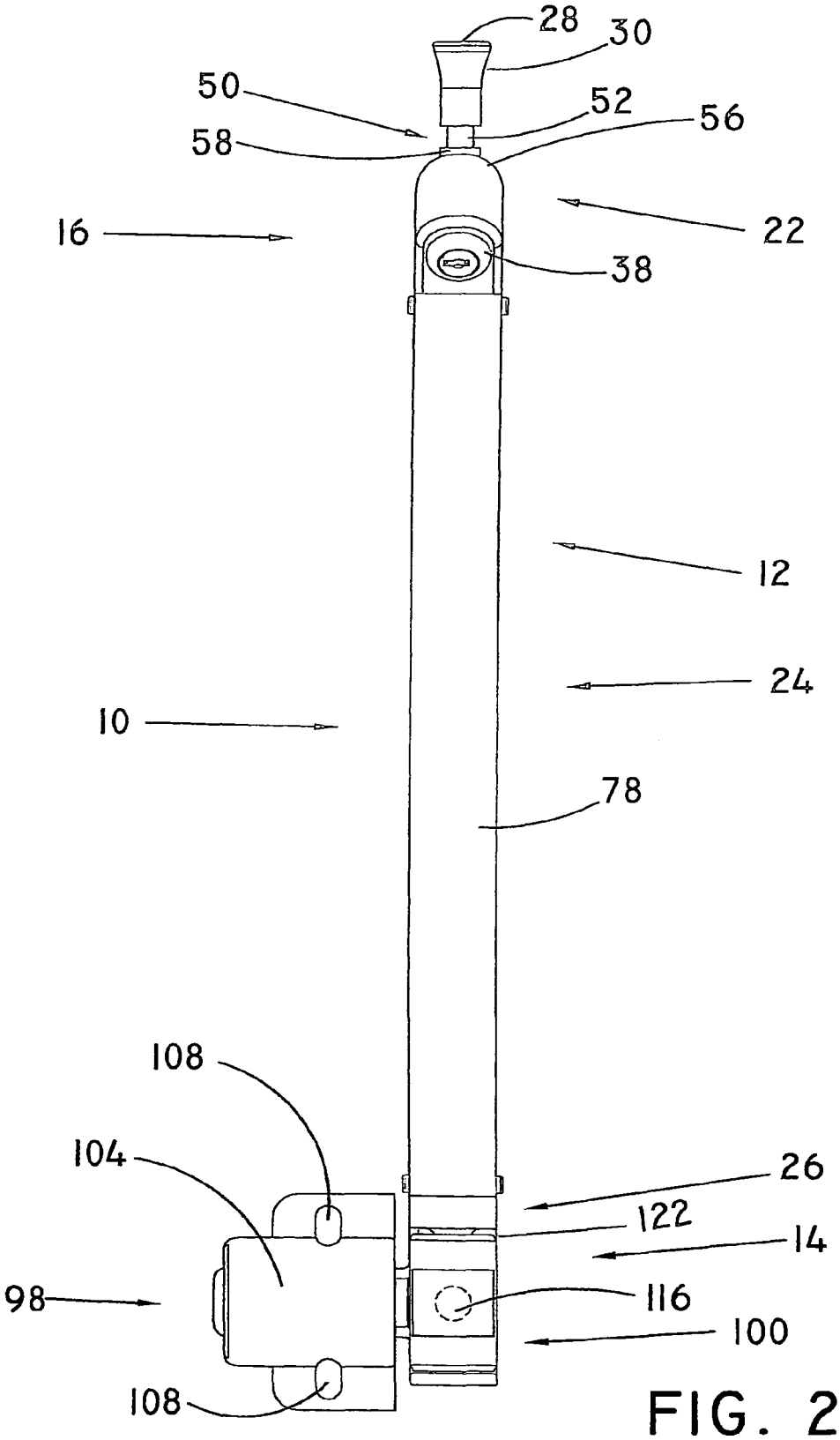
FIG. 2 is a front view of the magnetic latch device of the present invention.
Figure 3:
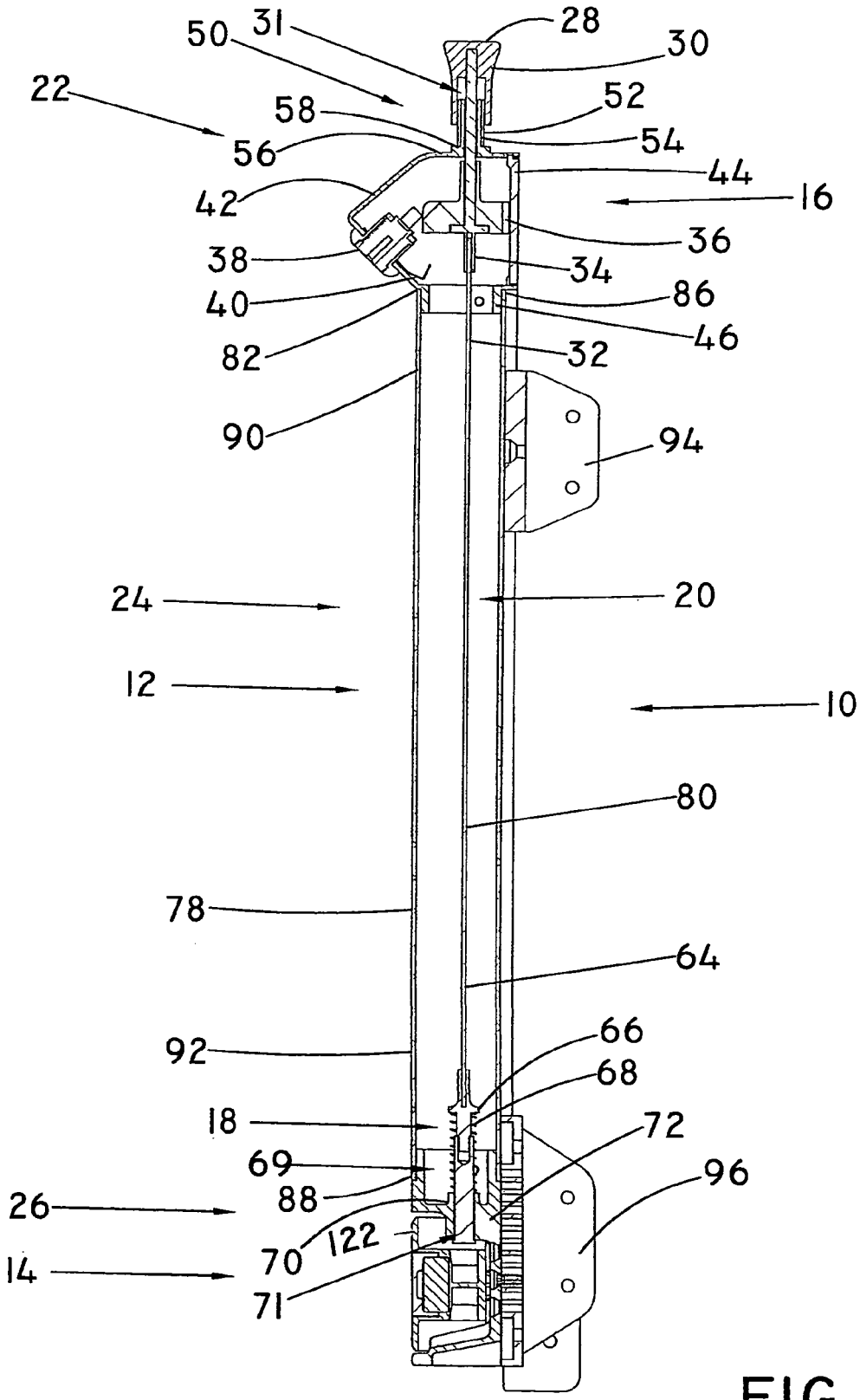
FIG. 3 is a cross-sectional side view of the magnetic latch device of the present invention.

As shown in FIGS. 1 through 3, the present invention relates to a magnetic gate latch device generally indicated as 10 comprising a latch assembly generally indicated as 12 mounted to a fence post (not shown) adjacent an opening or portal in a fence or other barrier (not shown) and a keeper assembly generally indicated as 14 attached to a gate (not shown) movable between an open position and a closed position to close or block the opening or portal (not shown) when the gate (not shown) is in the closed position.

Figure 4:
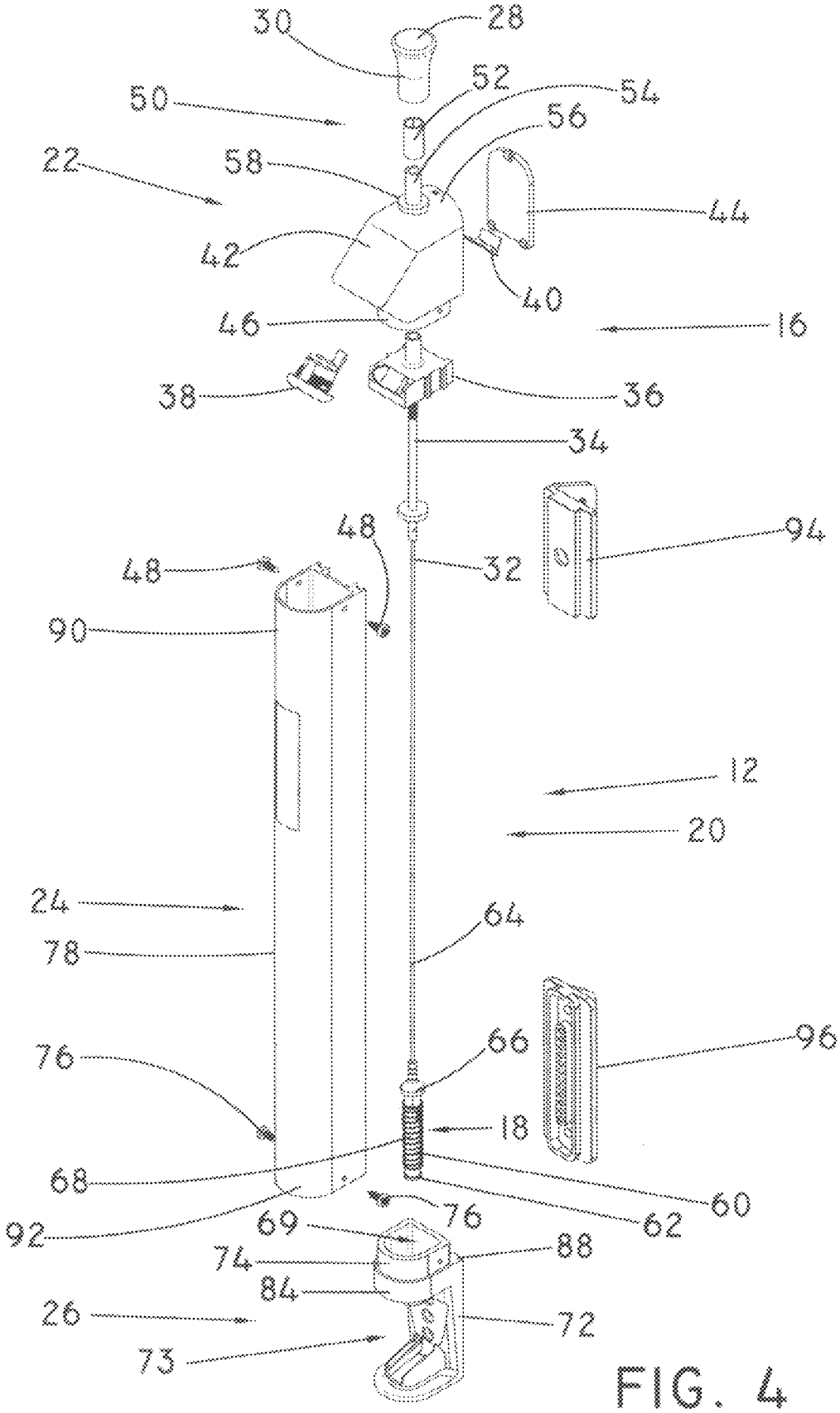
FIG. 4 is an exploded perspective view of the latch assembly of the magnetic latch device of the present invention.

As best shown in FIGS. 3 and 4, the latch assembly 12 comprises an upper latch actuator assembly generally indicated as 16 coupled to a lower latch assembly generally indicated as 18 by an intermediate interconnecting assembly generally indicated as 20 in combination with an upper lock housing, an intermediate cable housing and a lower latch housing generally indicated as 22, 24 and 26 respectively.

The upper latch pin actuator 16 comprises an actuator pull knob or member 28 having an arcuate or concave outer surface 30 and a recess or channel 31 formed therein attached to the upper portion 32 of the intermediate interconnecting assembly 20 by an upper connector 34. A lock assembly including a lock plate 36, a cylinder lock 38 and a cylinder lock clip 40 are operatively coupled to the upper lock housing 22 including an upper enclosure 42 and a back plate 44 to provide means to lock the magnetic gate latch device 10 by securing the keeper assembly 14 to the latch assembly 12. The upper lock housing 22 is affixed to the intermediate cable housing 24 by a flange or skirt 46 extending downwardly from the upper enclosure 42 and a plurality of fasteners each indicated as 48. A latch position indicator generally indicated as 50 is disposed on the upper portion of the upper enclosure 42 to provide a visual indication of the position of the lower latch assembly 20 relative to the keeper assembly 14 to indicate when the latch assembly 12 is in the upper or unlocked position and the lower or locked position as described hereinafter. The latch position indicator 50 may comprise a colored collar or sleeve 52 mounted to a hollow post 54 extending upwardly from the upper surface or top 56 of the upper enclosure 42 such that the colored collar or sleeve 52 is disposed entirely within the recess or channel 31 of the actuator pull knob or member 28 and therefore not visible to indicate that the lower latch assembly is in the lower or locked position when the lower periphery of the actuator pull knob or member 28 engages a ridge portion or stop 58 on the upper surface or top 56 of the upper enclosure 42.

The lower latch assembly 18 comprises a lower latch pin or member 60 including a lower flange or stop 62 formed on the lower portion thereof attached to the lower portion 64 of the intermediate interconnecting assembly 20 by a lower connector 66 and a bias or compression spring 68 disposed in surrounding relationship relative to the lower latch pin or member 60 to normally bias the lower latch pin or member 60 in the upper or unlocked position relative to the lower latch housing 26 as shown in FIG. 3.

The lower latch housing 26 comprises an inner lower latch housing recess 69 including a bias support shoulder 70 to support the bias or compression spring 68 and a centrally formed opening or channel 71 to receive at least a portion of the lower latch pin or member 60 and a lower latch base 72 including an outer recess 73 configured to receive the outer portion of the keeper assembly 14 when in the closed position. The lower latch housing 26 is affixed to the intermediate cable housing 24 by a flange or skirt 74 extending upward from the lower latch housing base 70 and a plurality of fasteners each indicated as 76.

The intermediate cable housing 24 comprises an intermediate sleeve or tube 78 to receive and house at least the major portion of the intermediate interconnecting assembly 20 comprising a cable or elongated element 80 operatively interconnecting the actuator pull knob or member 28 of the upper latch actuator 16 and the lower latch pin or member 60 of the lower latch assembly 18.

The flange or skirt 46 and flange or skirt 74 are recessed inward of the lower outer periphery 82 of the upper enclosure 42 and the upper outer periphery 84 of the lower latch housing 26 to form an upper ledge or ridge 86 and a lower ledge or ridge 88 respectively to receive the upper end portion or edge and lower end portion or edge 90 and 92 respectively to cooperatively form seals therebetween.

The latch assembly 12 is attached to the post of the fence or other barrier (not shown) by an upper mounting bracket 94 and a lower mounting bracket 96.

Figure 5:
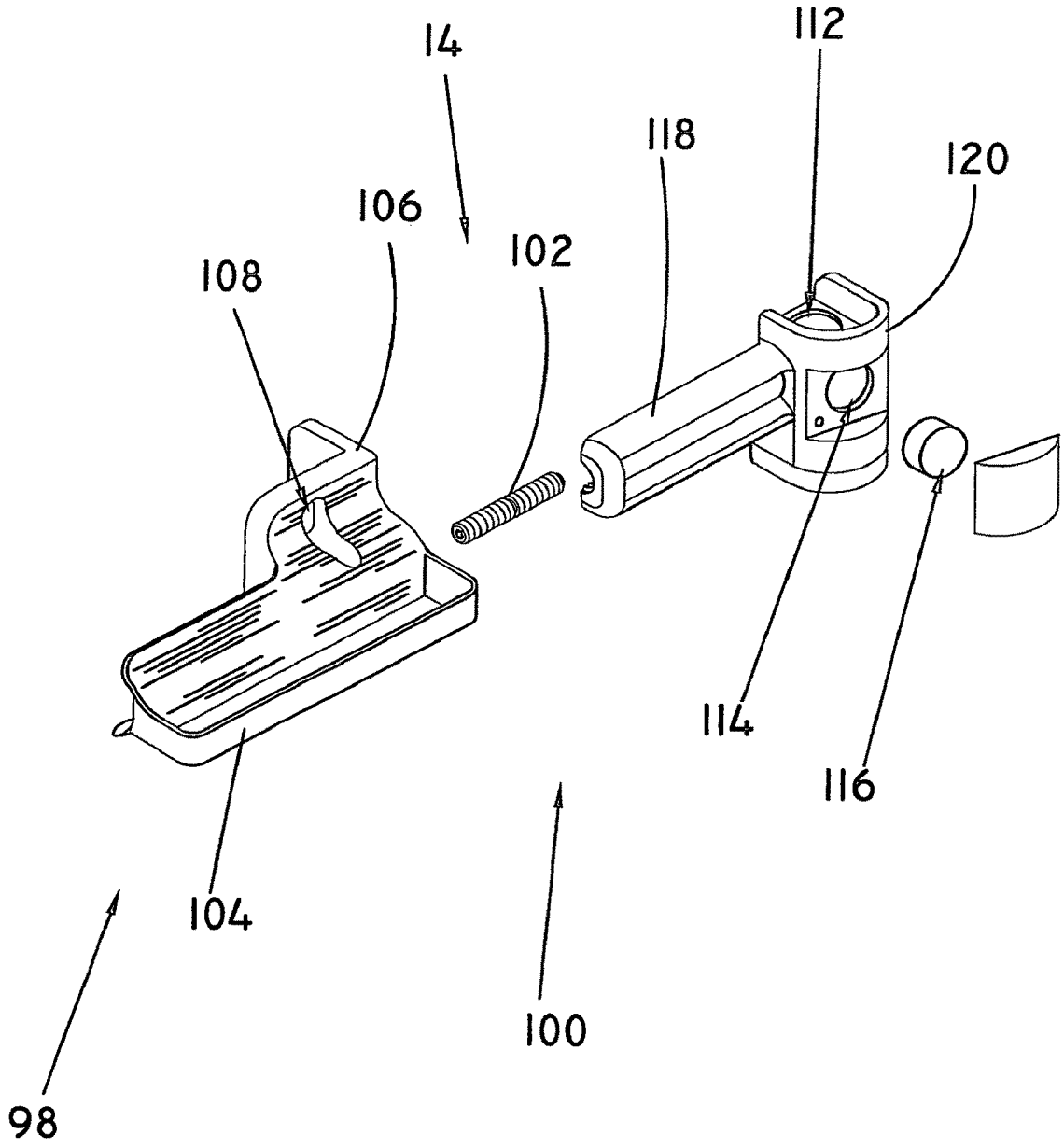
FIG. 5 is an exploded perspective view of the keeper assembly of the magnetic latch device of the present invention.
Figure 6:
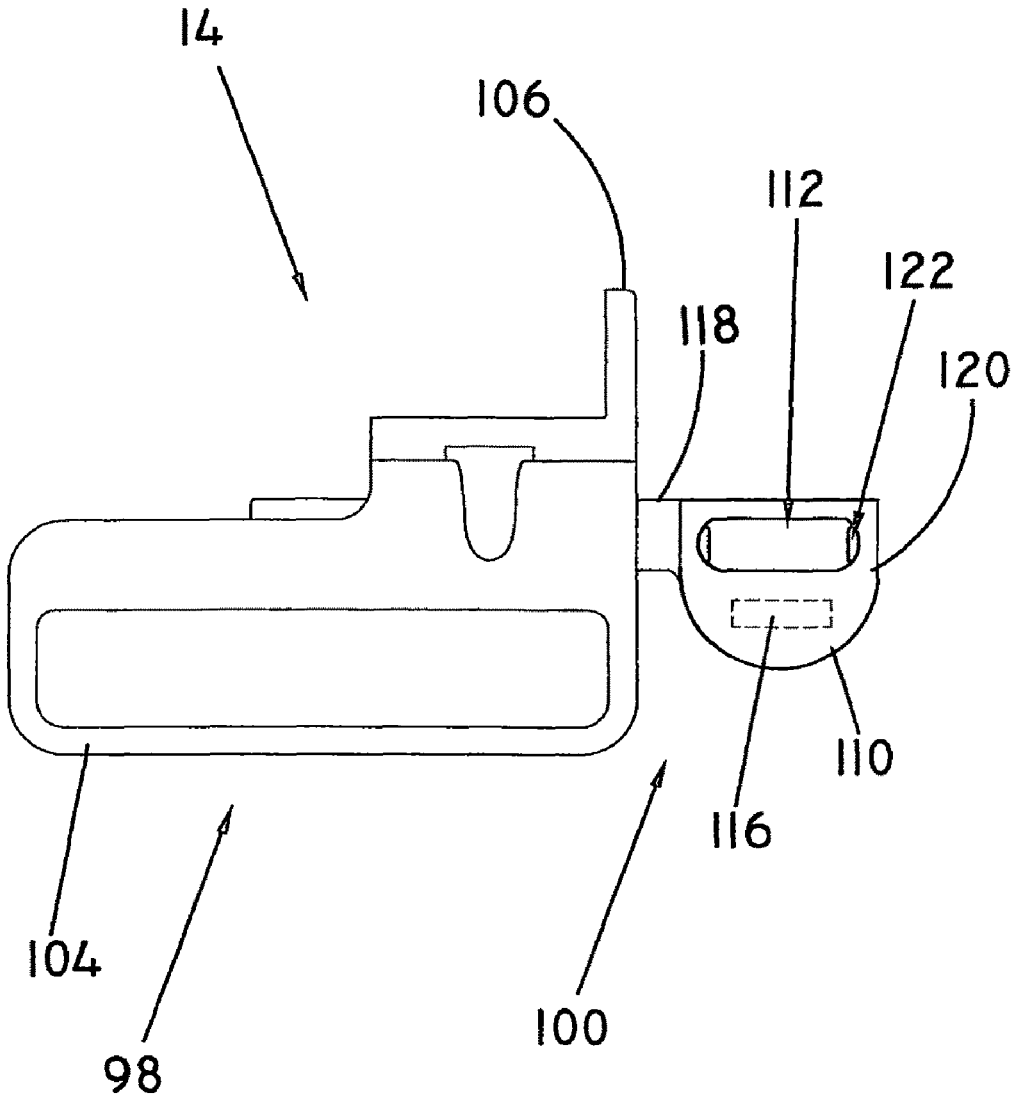
FIG. 6 is a top view of the keeper assembly of the magnetic latch device of the present invention.

As best shown in FIGS. 5 and 6, the keeper assembly 14 comprises a latch base generally indicated as 98 attached to the gate (not shown) having a latch arm generally indicated as 100 extending outwardly therefrom. The latch base 98 and the latch arm 100 are laterally adjustable relative to each other by an externally threaded member 102 that engages corresponding threads (not shown) formed on the latch base 98 and the latch arm 100.

The latch base 98 includes a handle 104 formed on the front portion thereof and a mounting bracket 106 having a substantially L-shaped configuration with a plurality of apertures each indicated as 108 to receive fasteners (not shown) therethrough to affix the keeper assembly 14 to the gate (not shown).

The latch arm 100 comprises a latch pin receptacle 110 including a latch pin recess 112 formed therein to receive the lower latch pin or member 60 when in the lower or locked position and a magnet recess 114 to retain a vertically disposed magnet 116 adjacent to the latch pin recess 112 coupled to the latch base 98 by a latch arm extension 118.

The upper peripheral edge 120 of the latch pin receptacle 110 is slanted inwardly to form a moisture run-off surface below the upper portion of the lower latch housing 26. At least one drain aperture 122 is formed in the latch pin receptacle 110.

The latch assembly 12 and the keeper assembly 14 are attached to the fence post (not shown) adjacent the fence opening (not shown) and the gate (not shown) respectively in proper alignment relative to each other.

The lower latch pin or member 60 is normally biased in upper or unlocked position. The vertically disposed magnet 116 disposed adjacent the latch pin recess 112 when the gate (not shown) is closed moves the lower latch pin or member 60, intermediate interconnecting assembly 20 and upper latch actuator 16 from the normally biased upper or unlocked position to a lower or locked position drawing the latch pin or member 60 into the latch pin recess 112 against the force of the bias 68. To release the keeper assembly 14 to open the gate (not shown) the upper latch pin actuator 16 is moved upwardly pulling the intermediate interconnecting assembly 20 upwardly and withdrawing the lower latch pin or member 60 from the latch pin recess 112 as the bias 68 maintains the lower latch pin or member 60 in upper or unlocked position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A gate latch device to secure a gate in a locked position to a fence or other barrier to close or block a portal formed therein comprising:

a latch assembly including an upper latch actuator assembly at least partially disposed within an upper lock housing affixed to a lower latch assembly at least partially disposed with a lower latch housing by an intermediate interconnecting assembly disposed with an intermediate cable housing;

a keeper assembly including a latch base affixed to the gate;

a lower latch pin movable between an upper or unlocked position and a lower or locked position coupled to an upper latch pin actuator by an intermediate interconnecting element mounted to the fence or other barrier adjacent the portal wherein said lower latch pin is normally biased in said upper or unlocked position by a bias;

a latch arm extending outwardly from a latch base having a latch pin recess formed therein;

a latch pin positioner disposed adjacent said latch pin recess to selectively move said lower latch pin from said upper or unlocked position to said lower or locked position;

a latch position indicator disposed on said upper lock housing to provide a visual indication of the position of said lower latch pin relative to said keeper assembly to indicate when said latch assembly is in said upper or unlocked position and said bias disposed to engage said lower latch pin to apply an upward force against said lower latch pin, said interconnecting element and said upper latch pin actuator such that when the gate is closed said latch pin positioner moves said lower latch pin, said intermediate interconnecting element and said upper latch pin actuator from said normally biased upper or unlocked position to said lower or locked position drawing said lower latch pin into said latch pin recess against the force of said bias and when as said upper latch pin actuator is moved upwardly said intermediate interconnecting element and said lower latch pin are moved upwardly withdrawing said lower latch pin from said latch pin recess to permit the gate to be opened as said bias holds said upper latch pin actuator, said intermediate interconnecting element, said lower latch pin in upper or unlocked position in spaced relationship relative to said latch pin recess to provide a visual indication of the position of said lower latch pin relative to said keeper assembly to indicate when said latch assembly is in the upper or unlocked position.

2. The gate latch device of claim 1 wherein the latch position indicator comprises a colored sleeve extending upwardly from said upper lock housing such that said colored sleeve is disposed entirely within a recess formed in said upper latch pin actuator to indicate that said lower latch pin is in the lower or locked position when the lower periphery of said upper latch pin actuator engages a portion of said upper lock housing.

3. The gate latch device of claim 2 wherein said upper latch pin actuator comprises an actuator pull knob having an arcuate outer surface coupled to the upper portion of said intermediate interconnecting assembly.

4. The gate latch device of claim 1 wherein said lower latch housing comprises a lower latch base including an outer recess configured to receive the outer position of said keeper assembly when the gate is in the locked position.

5. The gate latch device of claim 1 wherein said keeper assembly comprises a latch base attached to the gate having a latch arm extending outwardly therefrom.

6. The gate latch device of claim 5 wherein said latch arm comprises a latch pin receptacle including a latch pin recess formed therein to receive said lower latch pin when in the lower or locked position.

7. The gate latch device of claim 6 wherein said latch pin positioner comprises a magnet disposed adjacent said latch pin.

8. The gate latch device of claim 7 wherein said magnet is disposed laterally relative to said latch pin recess.

9. The gate latch device of claim 8 wherein the upper peripheral edge of the latch pin receptacle is slanted inwardly to form a moisture run-off surface below said intermediate latch housing.

10. The gate latch device of claim 9 further including at least one drain aperture formed in said latch pin receptacle.

11. The gate latch device of claim 8 further including at least one drain aperture formed in said latch pin receptacle.

12. The gate latch device of claim 5 wherein said latch base and said latch arm are laterally adjustable relative to each other.

13. The gate latch device of claim 12 wherein said latch base and said latch arm are laterally adjustable relative to each other by an externally threaded member that engages corresponding threads formed on said latch base and said latch arm.

14. The gate latch device of claim 5 wherein said latch base includes a handle formed on the front portion thereof.

15. The gate latch device of claim 14 wherein said latch base further includes a mounting bracket having a substantially L-shaped configuration to affix said keeper assembly to the gate.

16. The gate latch device of claim 5 wherein said latch base includes a mounting bracket having a substantially L-shaped configuration to affix said keeper assembly to the gate.

17. The gate latch device of claim 16 wherein said latch base and said latch arm are laterally adjustable relative to each other.

18. The gate latch device of claim 17 wherein said latch base and said latch arm are laterally adjustable relative to each other by an externally threaded member that engages corresponding threads formed on said latch base and said latch arm.

* * * * *